United States Patent [19]

Malafosse

[11] 4,451,384

[45] May 29, 1984

[54] HALOFORMAMIDINES BLEACHING AGENT ACTIVATOR FUNCTIONING TO RELEASE ACTIVE OXYGEN

[75] Inventor: Jean Malafosse, Sassenage, France

[73] Assignee: L'Air Liquide - Societe Anonyme pour l'Etude et l'Exploitation des Procedes Georges Claude, Paris, France

[21] Appl. No.: 309,503

[22] Filed: Oct. 7, 1981

[30] Foreign Application Priority Data

Oct. 24, 1980 [FR] France ..... 80 22754

[51] Int. Cl.[3] ..... C11D 3/26; C11D 7/54

[52] U.S. Cl. ..... 252/102; 8/107; 8/109; 252/95; 252/98; 252/186.29; 252/186.31; 252/186.38; 252/186.41; 252/186.43

[58] Field of Search ..... 252/98, 102, 186.38, 252/186.41, 186.29, 186.31, 186.43; 564/225, 244, 245; 260/543.1; 8/107, 109

[56] References Cited

U.S. PATENT DOCUMENTS

| | | | |
|---|---|---|---|
| 2,147,401 | 2/1939 | Eckelmann et al. | 564/225 |
| 2,211,280 | 5/1940 | Martin et al. | 564/244 |
| 2,727,922 | 12/1955 | Lecher et al. | 260/543.1 |
| 2,816,077 | 10/1957 | Courtier | 252/155 |
| 2,845,458 | 7/1958 | Lecher et al. | 260/543.1 |
| 3,299,081 | 1/1967 | Sletzinger et al. | 564/245 |
| 3,428,681 | 2/1969 | Kippur et al. | 252/155 X |
| 3,445,517 | 5/1969 | Mills | 564/244 |
| 3,487,156 | 12/1969 | Duerr et al. | 424/330 |
| 3,986,973 | 10/1976 | Loffelmann et al. | 252/103 |
| 4,202,786 | 5/1980 | Brubaker | 252/102 |
| 4,210,551 | 7/1980 | Brubaker | 252/102 |

FOREIGN PATENT DOCUMENTS

| | | |
|---|---|---|
| 1915668 | 10/1970 | Fed. Rep. of Germany . |
| 50-88044 | 7/1975 | Japan . |

*Primary Examiner*—P. E. Willis, Jr.

*Attorney, Agent, or Firm*—Browdy and Neimark

[57] ABSTRACT

Bleaching agent activators which function to release active oxygen. The activator is an amidine of the formula:

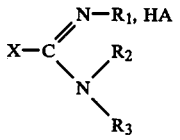

wherein X is hydrogen, a halogen, an alkyl, aryl, alkylaryl, cycloalkyl, thioalkyl, oxylalkyl, acyl, an inorganic acid radical such as $SO_3H$, or an organoinorganic radical, $R_1$, $R_2$ and $R_3$ designate hydrogen, an alkyl, aryl, alkylaryl, cycloalkyl or acyl radical; HA designates an inorganic or organic monoacid or the equivalent part of a polyacid. This class of amidines improves the effectiveness, at regular or moderate temperature, of liquid or solid bleaching agents, such as hydrogen peroxide, alkaline perborates and percarbonates.

13 Claims, No Drawings

HALOFORMAMIDINES BLEACHING AGENT ACTIVATOR FUNCTIONING TO RELEASE ACTIVE OXYGEN

FIELD OF THE INVENTION

This invention relates to activators for bleaching at moderate temperatures, intended particularly for detergents and detersive containing compounds able to function to release active oxygen as the bleaching agent.

BACKGROUND OF THE INVENTION

Liquid bleaching agents generating active oxygen, such as hydrogen peroxide, and solid bleaching agents, such as persalts such as sodium perborate, decompose at sufficiently fast speed to be compatible in a bleaching process only when bleaching is conducted at a temperature above 70° C.

Household working powders used at moderate temperatures are a topic of current concern when linked to the problem of energy savings. Further, use in a washing machine of bleaching agents which are effective at a temperature below 60° C. offers a certain number of advantages. In the case of cotton fabrics, bleached under such conditions, less degradation is noted and consequently a reduction in the wear of the clothes. An improved bleaching result is observed in synthetic fabrics or textile articles which are treated with a sizing assuring their crease resistance and permanent press qualities, which cannot be obtained when bleaching at a temperature above 60° C. Bleaching at a moderate temperature also reduces the risk of chemical attack of the dyes or their transfer from one fabric to the other. This type of bleaching also promotes the fight against pollution by lowering the polyphosphate content of the waste waters. It is known that in general washing powders contain up to 40% polyphosphates the purpose of which is to sequester calcium ions ($Ca^{++}$) present in hard water to avoid formation of an incrustation deposit on textile fibers. This incrustation is due to precipitation of calcium carbonate; however, if the temperature stays below 60° C., the rate of transformation of $HCO_3^-$ into $CO_3^=$ diminishes and consequently precipitation of calcium carbonate on the textile fibers diminishes. Also, use of laundry powders at a temperature below 60° C. could reduce their polyphosphate content and therefore decrease the type of water pollution that causes entrophication of lakes and rivers.

A great number of molecules have been studied and proposed for use as activators of compounds generating active oxygen. French Pat. No. 1,232,554 describes the use of organic acylamides, particularly organic acetyl amide. Of these acetyl derivatives of amines, tetraacetylethylenediamine: $(CH_3CO_2)N—(CH_2)_2—N—(COCH_3)_2$ or TAED, mentioned in French Pat. No. 1,258,675 now is incorporated into the composition of commercial washing powders.

There is also known from U.S. Pat. No. 4,025,453 a process of activating a peroxide base bleaching agent contained in an aqueous medium by adding to the peroxide base bleaching agent (a) cyanamide and/or metallic cyanamide in an amount suitable for activating the peroxide, and (b) optionally a Group II A metal compound, keeping the aqueous medium in an alkaline state and optionally incorporating a buffer therein, provided that if constituent (a) is cyanamide and if constituent (b) is absent, the aqueous medium is kept at a pH greater than 7.5.

SUMMARY AND OBJECTS OF THE INVENTION

A new class of compounds carrying the amidine group have been found which are simple and economical to make, particularly with respect to the manufacture of the tetraacetylethylenediamine molecule and said amidine group compounds have advantageous capacities for activating active oxygen generators.

This new class of compounds carrying the amidine group, which improves the effectiveness, at regular or moderate temperature, of liquid or solid bleaching agents, such as hydrogen peroxide, alkaline perborates such as sodium perborate and alkaline percarbonate such as sodium percarbonate, is represented by the general formula:

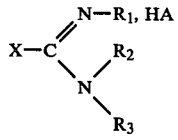

(I)

wherein X designates a hydrogen atom, a halogen, an alkyl, aryl, alkylaryl, cycloalkyl, oxyalkyl radial such as $O—CH_3$, a thioalkyl radical such as $S—CH_3$, an acyl radical such as $—CO—CH_3$, an inorganic acid radical such as $SO_3H_1$ or an organoinorganic radical such as $CH_2PO_3H_2$; $R_1$, $R_2$ and $R_3$ each designate a hydrogen atom, an alkyl, aryl, alkylaryl, cycloalkyl, or an acyl radical such as acetyl $—CO—CH_3$.

The amidines are generally strong, stable bases in the form of an inorganic or organic acid salt; in formula (I), HA symbolizes an inorganic or organic mono-acid; H represents the proton and A a monovalent anion; optionally a polyacid can be linked to one or more amidine molecules.

The haloformamidines are in free form or in the form of an acid salt represented by the formula:

$$Y—C(=NH)—NH_2, HA \quad (I)$$

wherein Y is a halogen, particularly chlorine or bromine, HA designating an inorganic or organic acid; and constitute a particularly advantageous group of activators of hydrogen peroxide or solid compounds releasing hydrogen peroxide at moderate temperature.

Chloroformamidine 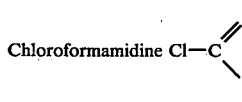

is endowed with a great activation capacity; it can be in hydrochloride or nitrate form, but the practical advantage of the much more stable sulfur and phosphorus derivatives should be noted. These amidines offer the advantage of being more active than tetraacetylethylene diamine (TAED), easier to handle than cyanamide $CN_2H_2$ and are much more soluble than calcium cyanamide, $CaCN_2$.

Other haloformamidines, in free form or as inorganic acid salts, such as bromoformamidine

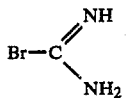

are also endowed with a strong activation capacity, formamidine H—C(=NH)$NH_2$; acetamidine $H_3C$—C(—NH)$NH_2$; methyl isothiourea $CH_3$—S—C(—NH)$NH_2$ are also perborate activators. The haloformamidine salts can be used alone in the pure state or in mixtures.

U.S. Pat. No. 4,025,453 has shown that cyanamide $H_2N$—C≡N and alkaline or alkaline earth salts are also very good bleaching activators of peroxygen compounds. Because of their very low molecular weight, an effectiveness equivalent to that of TAED is obtained by using concentrations about one-third that of TAED. However, use of these compounds can present very serious drawbacks because, in the case of the cotton fabrics, they cause a strong degradation of the cellulose fiber; further, like TAED, they are relatively destructive in regard to some particularly fragile dyes; finally, some are also difficult to handle such as cyanamide $H_2N$—CN or are only slightly soluble in water when used in the form of its $Ca^{++}$ or $Mg^{++}$ salts.

Another drawback of the cyanamide bleaching activators is that they have their effectiveness greatly reduced when the bleaching bath contains transition metal cations, particularly $Fe^{3+}$ and $Cu^{2+}$ cations, as impurities.

For activators containing the amidine function, these secondary disadvantageous effects are very much reduced if not totally absent.

In particular chloroformamidine sulfate (CFS)

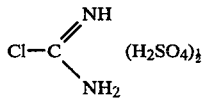

in the activator that combines a very good activity with a minimum of secondary effects.

It is generally assumed that haloformamidine salts, particularly chloroformamidine chloride, behave in aqueous solution as cyanamide generators; if this were the case, during bleaching at moderate temperature, the use of these salts would cause the same secondary effects in regard to degradation of cellulose. However, it has been shown that these effects are greatly reduced, especially in the case of chloroformamidine sulfate.

On the other hand, it has been shown that the amidine function by itself has certain activity. It can be concluded that the mechanism of activation of peroxide oxygen induced by haloformamidine salts is different from that of cyanamide activity, and that, in this case, these products do not behave as cyanamide generators. The activity of the amidine function can be increased by substitution, on the carbon carrying the amine and imine groups, of a strongly electronegative element such as chlorine or bromine.

The invention also has the following objects:

A stable bleaching composition formed by a bleaching agent able to release active oxygen in association with an amidine, represented by formula I, in sufficient amount to activate said bleaching agent.

A stable, solid bleaching agent constituted by association of a water-soluble, powdery solid derivative, which releases hydrogen peroxide in an alkaline aqueous solution such as sodium perborate, sodium percarbonate, perpyrophosphate, persilicate, urea peroxide, and all the inorganic or organic hydroperoxidates, with an amidine from the class of compounds represented by formula I in sufficient amount to activate release of active oxygen at moderate temperature.

A stable, liquid bleaching composition constituted by hydrogen peroxide in association with an amidine according to formula I, in an amount necessary for activation of the hydrogen peroxide at moderate temperature.

The bleaching compositions activated by an amidine can be used in bleaching any bleachable substance using a bleaching compound suitable for releasing active oxygen.

The bleaching compositions according to the invention are especially suited for household and industrial washing of natural, artificial and synthetic fibers at moderate temperature. In these cases of washing, the compositions of the invention are used jointly with detergents or detersives, such as a commercial washing powder free of bleaching agent.

DETAILED DESCRIPTION OF PREFERRED EMBODIMENTS

Examples are given below that illustrate, in a nonlimiting way, the activation properties of the amidines according to the invention.

The activation capacity of these molecules in regard to hydrogen peroxide or solid compounds releasing hydrogen peroxide in an alkaline aqueous solution is shown by the bleaching tests conducted at 30° and 60° C. in a Terg-O-Tometer apparatus.

Three test methods are used:

(a) In the first, six squares of cotton, 10 cm square, are used: two soiled by pouring on tea, two by pouring on coffee and two with red wine; they are immersed in a washing bath which is brought to test temperature. The washing bath, whose pH is between 9 and 10.5, contains a commercial washing powder without any bleaching agent, sodium perborate at a rate of 1.5 g/l as the bleaching agent and optionally an activation agent; optionally a sodium carbonate buffer is provided to keep the pH at a suitable value. Washing with agitation lasts 40 minutes; after rinsing, drying and ironing, the degree of whiteness is measured with an ERELPHO apparatus.

The result is expressed in average % of removal of wine, tea, coffee spots, calculated by the formula:

$$\% \text{ removal} = \frac{DL - DS}{DB - DS} \times 100$$

wherein

DL: d° of white of washed fabric

DB: d° of white of unwashed fabric

DS: d° of white of soiled fabric;

the consumption of active oxygen is also measured.

(b) A second faster method is used in which, in each test, six cotton squares soiled by pouring of tea are used; after the test as described above, the degree of whiteness are measured with an Electrosynthesis apparatus provided with a blue filter; the various constituents of the mixture are dissolved in a buffer solution having a base of sodium hydroxide and bicarbonate.

(c) In the third method, the same soiling means are used as in the first method and the same buffer solution and measurement of degree of whiteness are used.

EXAMPLE 1

Amidine function

The activation capacity of the amidine function in the form of acetamidine hydrochloride in measured according to the test protocol described except that measurement of the degree of whiteness is made with an Electrosynthesis apparatus and the result is expressed in degrees of whiteness and not in percentage of spot removal; the results are shown in the table below, which show a significant activation effect of the amidine function at 60° C.:

| | (d°) degree of whiteness | | | |
|---|---|---|---|---|
| | wine | tea | coffee | pH |
| at 30° C. | | | | |
| Control without activator | 67 | 81.5 | 64 | 9.6 |
| 0.1 g activator | 65 | 84 | 64.5 | 9.8 |
| 0.3 g activator | 64 | 82 | 64 | 9.8 |
| TAED: 0.3 g | 72 | 87.5 | 68.5 | 9.7 |
| at 60° C. | | | | |
| Control without activator | 76 | 89 | 70 | 9.6 |
| 0.1 g activator | 78 | 92 | 74 | 9.8 |
| 0.3 g activator | 80.5 | 93 | 75 | 9.8 |
| TAED: 0.3 g | 85 | 95 | 78 | 9.8 |

EXAMPLE 2

A comparison is made at 30° and 60° C. of the percentage of spot removal obtained by test protocol (a) by using chloroformamidine hydrochloride (CFC) and tetraacetylethylene diamine (TAED) as the activator. The results are grouped in the table below; AO=active oxygen.

| COMPOSITIONS | | | | RESULTS | | | | | |
|---|---|---|---|---|---|---|---|---|---|
| | | | | WASHINGS AT 30° C. | | | WASHINGS AT 60° C. | | |
| washing powder g/l | perborate g/l | activator g/l | $Na_2CO_3$ g/l | % removal wine - tea - coffee | % residal AO | final pH | % removal wine - tea - coffee | % residal AO | final pH |
| 9 | — | — | — | 32 | — | 9.6 | 36 | — | 9.5 |
| 9 | 1.5 | — | — | 37 | 100% | 9.7 | 53 | 96% | 9.6 |
| | | TAED | | | | | | | |
| 9 | 1.5 | 0.6 | — | 54 | 29% | 9.3 | 67 | 14% | 9.2 |
| | | CFC | | | | | | | |
| 9 | 1.5 | 0.2 | — | 44 | 89% | 9.4 | 64 | 64% | 9.3 |
| 9 | 1.5 | 0.4 | — | 43 | 87% | 9.1 | 66 | 47% | 9 |
| 9 | 1.5 | 0.6 | 0.6 | 46 | 77% | 9.1 | 68 | 26% | 9 |
| 9 | 1.5 | 0.2 | 1 | 49 | 83% | 9.7 | 64 | 64% | 9.7 |
| 9 | 1.5 | 0.4 | 2.2 | 56 | 60% | 9.7 | 70 | 32% | 9.7 |
| 9 | 1.5 | 0.6 | 3.7 | 59 | 43% | 9.7 | 72 | 10% | 9.8 |

It is deduced that, in bleaching activator reactions taking place at a pH on the order of 9.7, the addition of 0.3 chloroformamidine hydrochloride is chemically equivalent to that of 0.6 g of TAED.

EXAMPLE 3

In test method (b) a comparison is made of the degrees of whiteness obtained on the tea stains using various amidines, the results are given in table 2 below.

| | N° | | pH 30° C. | | pH 60° C. | |
|---|---|---|---|---|---|---|
| | | 0,00 g/l | 9,6 | 80 | 9,6 | 89 |
| Cl—Am. HCl | 1 | 0,23 g/l | 10,3 | 89 | 10,1 | 95 |

-continued

| | N° | | pH 30° C. | | pH 60° C. | |
|---|---|---|---|---|---|---|
| Br—Am. Hbr | 2 | 0,4 g/l | 9,5 | 85 | 10,1 | 95 |
| $CH_3$—Am.HOOC—$CH_3$ | 3 | 0,3 g/l | 10,3 | ,5 | 10,1 | 94 |
| $CH_3O$—Am. $H_2SO_4$ | 4 | 0,3 g/l | 10 | 85,5 | 10 | 96 |
| $[CH_3S$—Am.$]_2$ $H_2SO_4$ | 5 | 0,3 g/l | 10,1 | 87,7 | 10 | 95 |
| H—Am. $HOOCCH_3$ | 6 | 0,5 g/l | 11,1 | 81 | 11 | 94 |

In the first column of the above table, the group

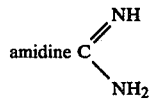

is designated by Am.

It was found that, aside from formamidine acetate (n° 6) which is rather inactive, all the other amidines tested are effective. This shows well the activating effect of this group; this effect can be modified by substitution; substitution of the carbon carrying imino or amino groups with an electronegative element, such as chlorine, reinforces the effectiveness of the activation of the molecule; this is the case with chloroformamidine.

EXAMPLE 4

According to the protocol of test (c) the effectiveness of acetamidine hydrochloride was measured by the degree of whiteness after washing; the results are given below.

| | (d°) degrees of whiteness | | | |
|---|---|---|---|---|
| | wine | tea | coffee | pH |
| at 30° C. | | | | |
| Control without activator | 67 | 81.5 | 64 | 9.6 |
| 0.1 g activator | 65 | 84 | 64.5 | 9.8 |
| 0.3 g activator | 64 | 82 | 64 | 9.8 |
| TAED : 0.3 g | 72 | 87.5 | 68.5 | 9.7 |
| at 60° C. | | | | |
| Control without activator | 76 | 89 | 70 | 9.6 |
| 0.1 g activator | 78 | 92 | 74 | 9.8 |
| 0.3 g activator | 80.5 | 93 | 75 | 9.8 |
| TAED : 0.3 g | 85 | 95 | 78 | 9.8 |

The results of this test, more severe than the preceding one, confirm the positive effect of the amidine function at 60° C.

EXAMPLE 5

The activation effect of chloroformamidine sulfate (CFS) was examined by using the same test protocol as in example 2. The results are given in the following table.

| COMPOSITIONS | | | | RESULTS | | | | | |
|---|---|---|---|---|---|---|---|---|---|
| | | | | WASHINGS AT 30° C. | | | WASHINGS AT 60° C. | | |
| washing powder g/l | perborate g/l | activator | $Na_2CO_3$ g/l | removal wine - tea - coffee | residal AO | final pH | removal wine - tea - coffee | residal AO | final pH |
| | | CFS | | | | | | | |
| 9 | 1.5 | — | — | 31 | 100% | 9.7 | 52 | 100% | 9.7 |
| 9 | 1.5 | 0.2 | 0.5 | 44 | 92% | 9.7 | 70 | 77% | 9.7 |
| 9 | 1.5 | 0.4 | 1 | 51 | 77% | 9.7 | 73.5 | 46% | 9.7 |
| 9 | 1.5 | 0.6 | 1.5 | 54 | 64% | 9.7 | 74.5 | 21% | 9.7 |
| | | TAED | | | | | | | |
| 9 | 1.5 | 0.6 | — | 52 | 63% | 9.3 | 69 | 20% | 9.4 |

To obtain a bleaching effectiveness comparable to that obtained with 0.6 g of TAED, it is necessary to use about 0.4 g of CFS at 30° C. and only 0.2 at 60° C.

EXAMPLE 6

Effect on cellulose

The "AHIBA" apparatus was used under the following conditions:

Bath 600 ml

Weight of Empa 301 fabric 12 g

Total washing time 40 min (of which 30 min at temperatures up to 90° C.)

(of which 20 min at temperatures up to 60° C.)

Rinsing in tepid warm water was done after each washing.

Thus, a succession of 10 washings at 60° C. and at 90° C. was performed; then the degree of polymerization of the cellulose (DP) was measured.

The results are given in the following table in which are indicated, on the one hand, the residual DP after 10 washings at 60° C. and, on the other hand, the residual DP after 10 washings at 90° C.

The initial DP of the EMPA 301 fabric (S27) was 2,000.

| washing powder g/l | perborate g/l | activator | g/l | DP after 10 washings at 60° C. | at 90° C. |
|---|---|---|---|---|---|
| 9 | — | — | | — | 1920 |
| 9 | 1.5 | — | | 1940 | 1580 |
| 9 | 1.5 | $CaCN_2$ | 0.4 | 1240 | 1000 |
| 9 | 1.5 | " | 0.3 | 1400 | 1130 |
| 9 | 1.5 | " | 0.2 | 1580 | 128O |
| 9 | 1.5 | $HNaCN_2$ | 0.2 | 1770 | 1430 |
| 9 | 1.5 | " | 0.4 | 1400 | 1030 |
| 9 | 1.5 | CFC | 0.4 | 1460 | 1210 |
| 9 | 1.5 | CFS | 0.4 | 1940 | 1760 |
| 9 | 1.5 | TAED | 0.6 | 1930 | 1900 |

It was found that chloroformamidine sulfate (CFS), used in the dose where there is a good activator effectiveness, causes only a slight reduction in the degree of polymerization of the cellulose; in the same dose, sodium and calcium cyanamide salts cause a much higher degradation of the cellulose.

EXAMPLE 7

This particular test was performed to reproduce the action that a deposit of washing powder could have in a fold of the fabric when washing is done by soaking.

The washing powder mixtures, which differ only in nature and amount of activator, were placed in small bags of identical size, each made from the dyed fabrics to be tested. These bags were introduced in a beaker containing two liters of water at 50° C., and kept immersed for two hours; after this time, the bath temperature was about 40° C.; then, the small bags were unstitched and the fabrics rinsed and dried; then the degradation of the dyes was evaluated qualitatively in relation to the control treated in the same way but with a washing powder mixture without activator.

The dyed fabric samples used were: reactive turquoise: cotton fabric dyed with FGL reaction blue and phthalogen blue: cotton mesh dyed in a three-color process in Remazol.

The amounts used in each test were:

washing powder 6 g perborate 1 g activator 0.4 g in the case of CFS and TAED 0.2 g in the case of calcium or monosodium cyanamides.

It was found that none of the compositions used caused any degradation of the phthalogen blue.

The fabric dyed with reactive turquoise and having contained the mixture activated with $CaCN_2$ showed some small white spots after the tests.

A reactive brown was more sensitive than the two preceding ones but the color of the fabric that contained the mixture of washing powder and perborate without activator was not modified; the chloroformamidine sulfate caused only a fading of the coloring which remained uniform and without a ring; the monosodium cyanamide caused a more marked fading of the color and the formation of rings and spots that were rather diffuse and hardly visible; the fabric of the bag having contained $CaCN_2$ was marked by a multitude of small yellow stains; TAED most strongly degraded this dye: the fabrics having contained this activator took nonuniform light brown colorings bordering on yellow.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

I claim:

1. Stable bleaching composition which consists of a bleaching agent, able to release active oxygen, and an amidine bleaching agent activator functional at regular or moderate temperature to release active oxygen, said amidine activator being selected from the formula:

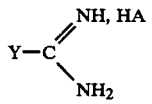

wherein Y is halogen, HA being an inorganic acid, said amidine activator being present in sufficient amount to activate said bleaching agent.

2. Stable bleaching composition according to claim 1, wherein said amidine activator is selected from the group of haloformamidines consisting of chloroformamidine in the form of chloride, nitrate, sulfate or phosphate, each alone or in mixture with one another.

3. Stable bleaching composition according to claim 1, wherein said amidine activator consists of chloroformamidine sulfate

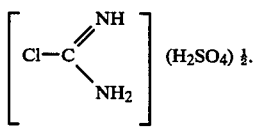

4. Stable solid bleaching composition made up by the association of a water-soluble powdery solid derivative releasing hydrogen peroxide in an alkaline aqueous solution and an amidine activator functional at regular or moderate temperature to release active oxygen, said amidine activator being selected from the formula:

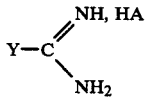

wherein Y is halogen, HA being an inorganic acid, said amidine activator being present in sufficient amount to activate the release of hydrogen peroxide at regular or moderate temperature.

5. Stable solid bleaching composition according to claim 4, wherein said amidine activator is selected from the group of haloformamidines consisting of chloroformamidine in the form of chloride, nitrate, sulfate or phosphate, each alone or in mixture with one another.

6. Stable solid bleaching composition according to claim 4, wherein said amidine activator consists of chloroformamidine sulfate

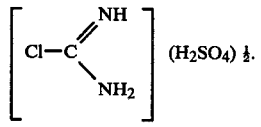

7. Stable solid bleaching composition according to claim 4 wherein the bleaching agent is sodium perborate.

8. Stable solid bleaching composition according to claim 4 wherein it further contains detergents.

9. Stable solid bleaching composition according to claim 7 wherein it further contains detergents.

10. Stable liquid bleaching composition consisting essentially of hydrogen peroxide and an amidine selected from the formula:

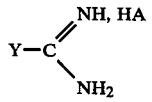

wherein Y is halogen, HA being an inorganic acid.

11. Stable liquid bleaching composition according to claim 10, wherein said amidine is selected from the group of haloformamidines consisting of chloroformamidine in the form of chloride, nitrate, sulfate or phosphate, each alone or in mixture with one another.

12. Stable liquid bleaching composition according to claim 10, wherein said amidine is chloroformamidine sulfate

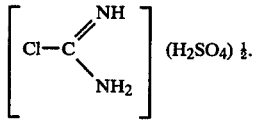

13. A method of activating an oxygen containing bleaching agent to release active oxygen, comprising mixing together a said bleaching agent capable of releasing active oxygen, water and an amidine of the formula:

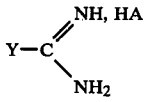

wherein Y is halogen, HA being an inorganic acid, said amidine being present in an amount sufficient to activate said bleaching agent.

* * * * *